US006123152A

United States Patent [19]

Edwards et al.

[11] Patent Number: 6,123,152

[45] Date of Patent: Sep. 26, 2000

[54] RETRIEVING WELL TOOLS UNDER PRESSURE

[75] Inventors: A. Glen Edwards, Hockley; Klaus B. Huber, Sugar Land, both of Tex.

[73] Assignee: Schlumberger Technology Corporation, Sugar Land, Tex.

[21] Appl. No.: 09/089,843

[22] Filed: Jun. 3, 1998

[51] Int. Cl.[7] ..... E21B 23/00

[52] U.S. Cl. ..... 166/377; 166/70; 166/77.51; 166/319

[58] Field of Search ..... 166/377, 319, 166/332.1, 70, 297, 298, 77.51, 77.52, 77.53

[56] References Cited

U.S. PATENT DOCUMENTS

| | | | |
|---|---|---|---|
| 3,877,529 | 4/1975 | Litchfield | 166/77.51 |
| 4,375,834 | 3/1983 | Trott | 166/297 |
| 4,598,771 | 7/1986 | Vann | 166/250 |
| 4,681,168 | 7/1987 | Kisling, III | 166/70 |
| 4,832,128 | 5/1989 | Light et al. | 166/377 |
| 5,025,861 | 6/1991 | Huber et al. | 166/297 |
| 5,044,437 | 9/1991 | Wittrisch | 166/250 |
| 5,123,356 | 6/1992 | Brooks et al. | 102/275.12 |
| 5,293,943 | 3/1994 | Williamson, Jr. | 166/319 |
| 5,509,481 | 4/1996 | Huber et al. | 166/297 |
| 5,529,127 | 6/1996 | Burleson et al. | 166/380 |
| 5,803,175 | 9/1998 | Myers, Jr. et al. | 166/70 |
| 5,848,646 | 12/1998 | Huber et al. | 166/70 |
| 5,967,236 | 10/1999 | Parker | 166/77.51 |
| 6,019,175 | 2/2000 | Haynes | 166/77.51 |

OTHER PUBLICATIONS

"Coiled Tubing Deployment System adapted for single Trip Perforating" by Campbell and Davidson dated Jun. 28–30, 1994.

Drawing, 1 pg. –3.06"O.D. × 2.88 I.D. Deployment Connector Assembly, Texas Oil Tools Inc., Jun. 22, 1994.

"Markham Well 49/5a–B2—2–7/8" TCP Guns on Coiled Tubing with the Deployment System —Report".

Article entitled "TCP Perforating on Coiled Tubing Utilizing a Deployment System" dated Mar. 13–16, 1995.

"Perforating and Testing Review" dated May 1995.

PCT/US97/01201 Search Report mailed Jun. 16, 1997 relating to this application, 7 pgs. "4.06" Safeconn Development System 10,000 psi Working Pressure" Texas Oil Tools, Mar. 1994, 25 pages.

"Toolstring Deployment System Trials" Nowsco Well Services, Jul. 1994, 21 pages.

(List continued on next page.)

*Primary Examiner*—William Neuder
*Attorney, Agent, or Firm*—Trop, Pruner & Hu PC

[57] ABSTRACT

A shut-off valve for use in a downhole string of tools adapted to be retrieved from a well under pressure is disclosed. The valve has a housing and a piston slidably disposed within an axial bore of the housing. The housing has upper and lower ends configured for attachment to upper and lower portions, respectively, of the tool string. The valve defines an internal passage for hydraulic communication between the upper and lower tool string portions. The piston is arranged to, in first and second positions, permit and block, respectively, hydraulic communication along the internal passage. The housing has an outer surface defining upper and lower outer surface regions for engagement by two spaced apart seals of a retrieval head (such as a BOP). The housing also defines an outer port disposed between the upper and lower outer surface regions and arranged for hydraulic communication between the piston and the outer housing surface. The piston is adapted to be moved to its second position by an elevated pressure applied to the outer port, thereby blocking the internal passage and enabling the upper end of the housing to be disconnected from the upper tool string portion while the lower tool string portion is exposed to elevated well pressure. The valve is particularly useful for retrieving long strings of tools without killing the well. Methods of using the valve to uncouple upper and lower portions of a string of tools exposed to elevated well bore pressure are also disclosed.

18 Claims, 5 Drawing Sheets-

OTHER PUBLICATIONS

"Tool Deployment System Incorporating Connect Perforating System", Guiberson AVA and Dressler, Jun. 1994, 17 pages.

"Coiled Tubing 1995 Update: Production applications" by Sas–Jaworsky II, et al., World Oil, vol. 216, No. 6, Jun. 1, 1995, pp. 97–105.

"Safe Deployment of Specialized Coiled–Tubing in Live Wells" by H.V. Thomeer, et al., SPE Proceedings, No. SPE 24621, Oct. 4, 1992, 799–808.

RETRIEVING WELL TOOLS UNDER PRESSURE

BACKGROUND OF THE INVENTION

This invention relates to shut-off valves for use in a downhole string of tools adapted to be retrieved from a well under pressure.

In completing a product recovery well, such as in the oil and gas industry, several downhole tasks or functions must generally be performed with tools lowered through the well pipe or casing. These tools may include, depending on the required tasks to be performed, perforating guns that ballistically produce holes in the well pipe wall to enable access to a target formation, bridge plug tools that install sealing plugs at a desired depth within the pipe, packer-setting tools that create a temporary seal about the tool and valves that are opened or closed.

Sometimes these tools are tubing-conveyed, e.g. lowered into the well bore on the end of multiple joints of tubing or a long metal tube or pipe from a coil, and activated by pressurizing the interior of the tubing. For strings of multiple hydraulically-activated tools, internal passages through upper tools along the string provide hydraulic communication between lower tools and the tubing. Such passages, particularly in perforating guns, may be breached by the operation of the tools and thereby exposed to well bore pressure and fluids. Sometimes such exposure is desirable to provide a path for circulating fluids down the tubing and out into the well bore as the tool is retrieved.

Often it is desirable to retrieve such tools with the well at an elevated pressure. Reducing the well head pressure to retrieve the tools (known as killing the well) can adversely affect subsequent well productivity. To retrieve tools under pressure, it is common to use a lubricator (a sealed stand pipe) above a blowout preventer (BOP; a well head bore seal). The tool string is pulled up into the lubricator under pressure, the blowout preventer is closed beneath the tool, and the lubricator pressure can then be bled off before removing the tool string. For tool strings which are internally sealed (e.g., do not have internal hydraulic passages which may be open to the well bore during retrieval), the blowout preventer (or similar sealing device) may be sealed about the outer diameter of the string below a joint between string sections, and the string sections removed one at a time.

Using this technique with strings having internal hydraulic passages open to the well bore, however, the maximum length of the tool string is generally limited to the length of the lubricator. The entire tool string is retrieved fully within the lubricator to form a seal by closing the blowout preventer, as sealing about the outer diameter of the tool string would not seal off well bore pressure because of the internal tool string passages.

SUMMARY OF THE INVENTION

This invention provides a means for retrieving long strings of hydraulically activated tools under pressure, in separate sections and without requiring a long lubricator.

According to one aspect of the invention, a shut-off valve is provided for use in a downhole string of tools adapted to be retrieved from a well under pressure. The valve includes a housing and a piston slidably disposed within an axial bore of the housing. The housing has upper and lower ends configured for attachment to upper and lower portions, respectively, of the tool string, and the valve defines an internal passage for hydraulic communication between the upper and lower tool string portions. The piston is arranged to, in first and second positions, permit and block, respectively, hydraulic communication along the internal passage. The housing has an outer surface defining upper and lower outer surface regions for engagement by two spaced apart seals of a retrieval head, such as a BOP. The housing also defines an outer port disposed between the upper and lower outer surface regions and arranged for hydraulic communication between the piston and the outer housing surface. The piston is adapted to be moved to its second position by an elevated pressure applied to the outer port, thereby blocking the internal passage and enabling the upper end of the housing to be disconnected from the upper tool string portion while the lower tool string portion is exposed to elevated well pressure.

In some embodiments at least one of the upper and lower outer surface regions of the housing defines a reduced outer housing diameter and has an edge defining a locating shoulder adapted to be engaged by the retrieval head to axially locate the valve within the retrieval head.

In some configurations the valve includes a frangible element extending between the piston and housing to temporarily retain the piston in its first position. The frangible element is arranged to be broken by an application of elevated pressure at the outer port to enable the piston to be moved to its second position. The frangible element may be in the form of a shear pin or multiple shear pins.

In some cases the housing includes a bore sleeve defining the axial bore of the housing, and a floating sleeve, with the frangible element extending between the piston and the floating sleeve such that, with the frangible element in an unbroken condition, the floating sleeve is arranged to bear against the bore sleeve as hydraulic force is applied to the piston to urge the piston toward its second position, and to remain unloaded as hydraulic force is applied to the piston to urge it away from its second position.

In some embodiments the valve also contains a collapsible element arranged to be plastically deformed by the piston as the piston moves to its second position, thereby absorbing piston kinetic energy. This collapsible element may be in the form of a coil of tubing arranged to be crushed axially between the housing and the piston, for example.

The upper and lower outer surface regions of the housing are adapted to be engaged by a dual combination blow-out preventer in some embodiments.

According to another aspect of the invention, the valve is adapted to be engaged by a single retrieval head seal. The valve housing is as described above, except that it has an outer surface with a sealing region for engagement by a retrieval head seal, the outer port being disposed above the sealing region. The piston is configured as described above. So configured, the valve may be used with a lubricator which is pressurized to operate the valve.

According to another aspect of the invention, a method of uncoupling upper and lower portions of a string of tools exposed to elevated well bore pressure is provided. The method includes the steps of (1) providing a shut-off valve made up between the upper and lower portions of the string, the shut-off valve having the features of the first invention aspect described above;

(2) raising the string from the well through a retainer head having upper and lower seals, until the shut-off valve is disposed within the retainer head and the upper string portion is disposed within an enclosed chamber;

(3) engaging the upper and lower outer surface regions of the shut-off valve by the retainer head seals;

(4) applying elevated pressure to the outer housing port to move the piston to its second position and close the shut-off valve;

(5) reducing pressure within the enclosed chamber;

(6) removing the upper string portion;

(7) pressurizing the enclosed chamber;

(8) retracting the retaining head seals; and (9) raising the lower string portion into the enclosed volume, which may be defined by a lubricator.

According to another aspect, another method of uncoupling upper and lower portions of a string of tools exposed to elevated well bore pressure is provided. The method is as described above, except that a shut-off valve of the construction of the second aspect described above is provided between the upper and lower portions of the string, step (3) involves engaging the sealing region of the shut-off valve by a seal of the retainer head, and step (8) is retracting the retaining head seal.

Other features and advantages will be apparent from the following description and claims.

DESCRIPTION OF EMBODIMENTS

Figure 1:
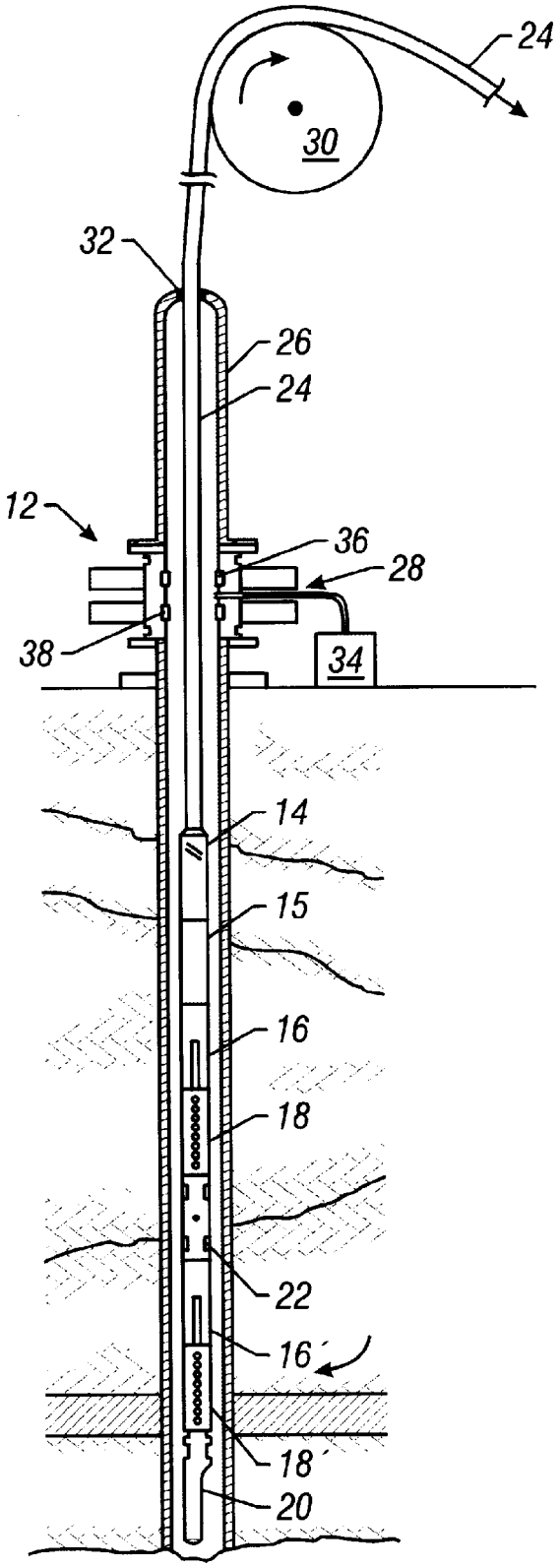
FIG. 1 illustrates a tubing-conveyed string of tools being pulled from a well through a blowout preventer into a lubricator under elevated well pressure.

Referring to FIG. 1, a tubing-conveyed string 10 of tools is shown being pulled up into a well head 12 after a completion. The string includes an upper section with a flapper valve 14, a swivel 15, a hydraulically activated firing head 16, and a perforating gun 18, and a lower section having a hydraulically activated firing head 16', a perforating gun 18', and an eccentric weight 20. An example of a hydraulically activated firing head for use in a multiple-tool string is disclosed in copending U.S. patent application Ser. No. 08/752,810 by Edwards, et al., the disclosure of which is incorporated herein by reference. Between the upper and lower sections, the string includes a shut-off valve 22, the function of which is more fully explained below with reference to FIGS. 2–4. The internal hydraulic conduit of the tool string (not shown) extends from tubing 24 through the upper tool string section and valve 22, and into lower firing head 16'.

String 10 is pulled upward on tubing 24, which is strung through a lubricator 26 and a dual-seal (dual combination) blowout preventer 28 as known in the art, trained about a pulley 30, and coiled about a reel (not shown). At the top of the lubricator, tubing 24 passes through a seal or packing 32, enabling the interior of the lubricator to be exposed to elevated well bore pressure during retrieval. A pressure source 34 is connected to the interior of the BOP between its upper and lower seals 36 and 38, respectively, to operate shut-off valve 22 as described below. The overall length of the tool string, as shown, is greater than the length of the interior of the lubricator above the lower BOP seal, such that string 10 may not be removed as a single piece under pressure.

Figure 2:
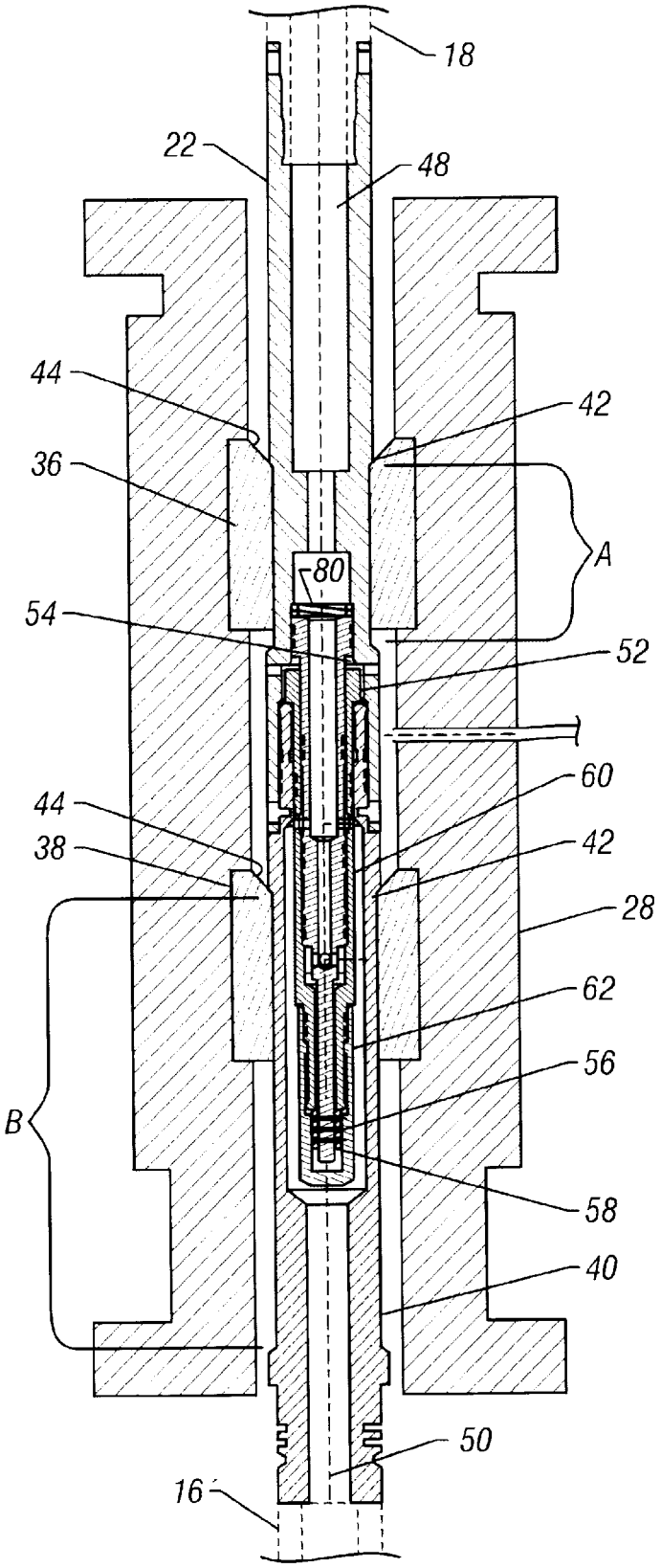
FIG. 2 is a cross-sectional view of the shut-off valve engaged by the dual seals of the blowout preventer.

To retrieve the tool string without killing the well, string 10 is first raised into the well head until valve 22 is aligned with BOP 28, as shown in FIG. 2. The BOP rams are extended to force seals 36 and 38 against the outer diameter of valve 22, as also shown in FIG. 2, thereby sealing the well annulus about the valve. The internal tool string hydraulic conduit through valve 22 is closed by pressurizing the BOP annulus between seals 36 and 38 (as explained below), thereby sealing off any potential breach, between the internal circuit and the well bore below the valve, from the interior of the lubricator. After tubing pressure has been increased to verify that the valve has closed, the lubricator is drained and removed, exposing the upper section of the tool string. The upper tool string section is removed, tubing 24 is reattached to the exposed end of valve 22, the lubricator replaced and pressurized, the BOP opened, and the remaining portion of the tool string pulled up into the lubricator for removal.

FIG. 2 shows valve 22, in cross-section, engaged by the seals of BOP 28. The outer diameter of the valve housing 40 is reduced in two areas to provide a sealing surface. The upper area of reduced diameter, region A, is engaged by upper BOP seal 36, and the lower area of reduced diameter, region B, is engaged by lower BOP seal 38. The upper edges 42 of these regions are tapered to match the angle of chamfers 44 on the upper surfaces of the BOP seals. Region B is substantially longer than lower seal 38, and provides a wide target for the initial alignment of the valve within the BOP. After the valve is approximately aligned (for instance, by raising the tool string to contact the upper end of the lubricator and lowering the string a predetermined amount), seal 38 is lightly closed about housing 40 in region B and the tool string is allowed to slide downward within the seal until edge 42 of region B is resting against the upper surface 44 of seal 38. Seal 38 is then fully engaged and seal 36 is extended to engage the housing in region A.

Once the BOP seals are in place, the closed annular space 46 between the seals is pressurized to an activation pressure greater than well bore pressure by the pressure source 34 shown in FIG. 1. The activation pressure is sufficient to cause the valve to permanently close, as explained below. Once the valve has closed, the joint above the valve can be broken and the tools above the valve (in this case, firing head 18 and up) removed.

FIG. 2 also illustrates the internal hydraulic conduit through valve 22, formed by upper bore 48, lower bore 50 and internal ports of the valve. The valve contains a piston 52, which shifts in response to activation pressure applied through a port 54 in the side of housing 40 to block further hydraulic communication between bores 48 and 50. Piston 52 is moved upward by the activation pressure, shearing a set of shear pins 56 extending between the piston and a floating sleeve 58, which abuts one end of a bore sleeve 60 threadably attached to the housing. Shear pins 56 are frangible, in that they are designed to be sheared at a predetermined shear load to release the piston.

Figure 3:
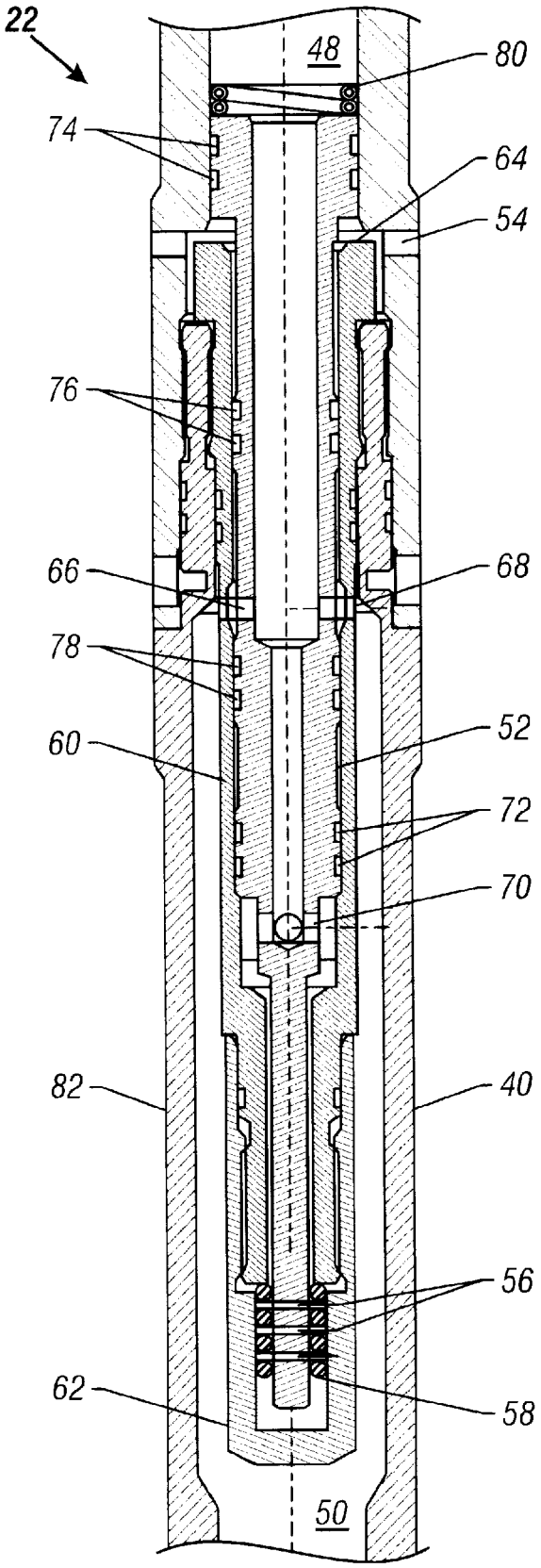
FIG. 3 is an enlarged, fragmentary cross-sectional view of the shut-off valve in its initial, open position.
Figure 4:
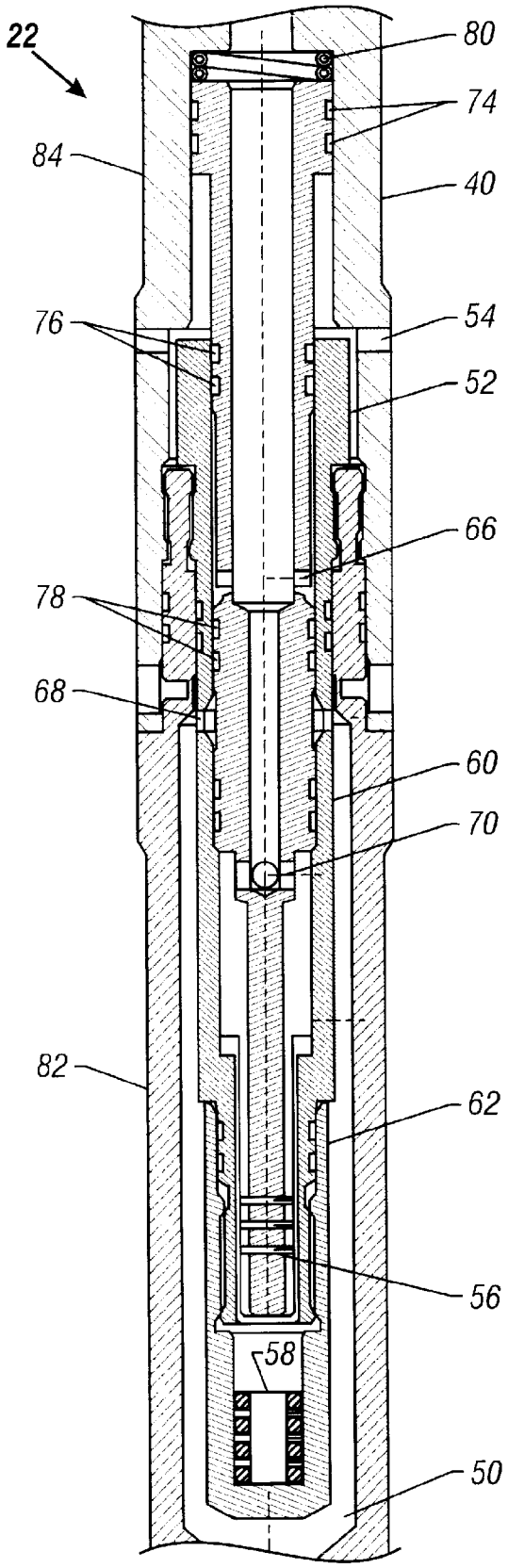
FIG. 4 is an enlarged, fragmentary cross-sectional view of the shut-off valve as closed.

FIG. 3 provides a closer view of piston 52, floating sleeve 58 and shear pins 56. The lower end of bore sleeve 60 is capped and sealed by a threaded cover 62. The piston is retained from moving upward by shear pins 56, but is free to move downward until stopped by the upper end 64 of bore sleeve 60. Hydraulic communication from bore 48 to bore 50 is provided, with the piston in this retained position, through ports 66 in piston 52 and ports 68 in bore sleeve 60. Other ports 70 in the piston, beneath seals 72, expose the lower end of the piston to conduit pressure, such that the net axial load applied by conduit pressure to the piston is downward, the pressure acting upon the difference in areas circumscribed by seals 74 and 76. BOP annulus pressure (well bore pressure before the BOP is sealed against the valve) acts to force the piston upward, acting on the same difference in sealing areas through ports 54. A net downward load on the piston is not transmitted through shear pins 56, due to the arrangement of floating sleeve 58, but a net upward load (corresponding, for instance, to a BOP annulus pressure greater than tubing pressure) is borne by pins 56. When a predetermined difference between BOP pressure and tubing pressure is exceeded (one valve was designed to close at a BOP pressure of 1500–3000 pounds per square inch with negligible tubing pressure), the shear pins fail and piston 52 rapidly moves upward. Once seals 78 traverse sleeve ports 68, further hydraulic communication between bores 48 and 50 is blocked (as shown in FIG. 4).

Once in its closed position (FIG. 4), the valve remains closed throughout the rest of the tool retrieval. The static friction provided by the seals along piston 52 is sufficient to resist the weight of the piston. Floating sleeve 58 is safely retained within cover 62 after the shear pins have been severed. As piston 52 reaches its uppermost position, a collapsible coil 80 of open-ended stainless steel tubing (which has been resting on the upper end of piston 52) is plastically deformed between the piston and housing 40. This deformation absorbs a portion of the kinetic energy of the piston, thereby reducing its impact and helping to avoid structural damage of the piston and housing. Tubing coil 80, of heavy wall stainless tubing, is easily replaced between jobs.

To assemble valve 22, piston 52 is lowered into bore sleeve 60 and pins 56 inserted through piston 52 and floating piston 58. Cover 62 is threaded over the lower end of sleeve 60 and this bore sleeve assembly is threaded into the lower valve housing 82. Coil 80 is placed upon the upper end of piston 52 and the upper valve housing 84 is threaded onto the lower valve housing.

Figure 5:
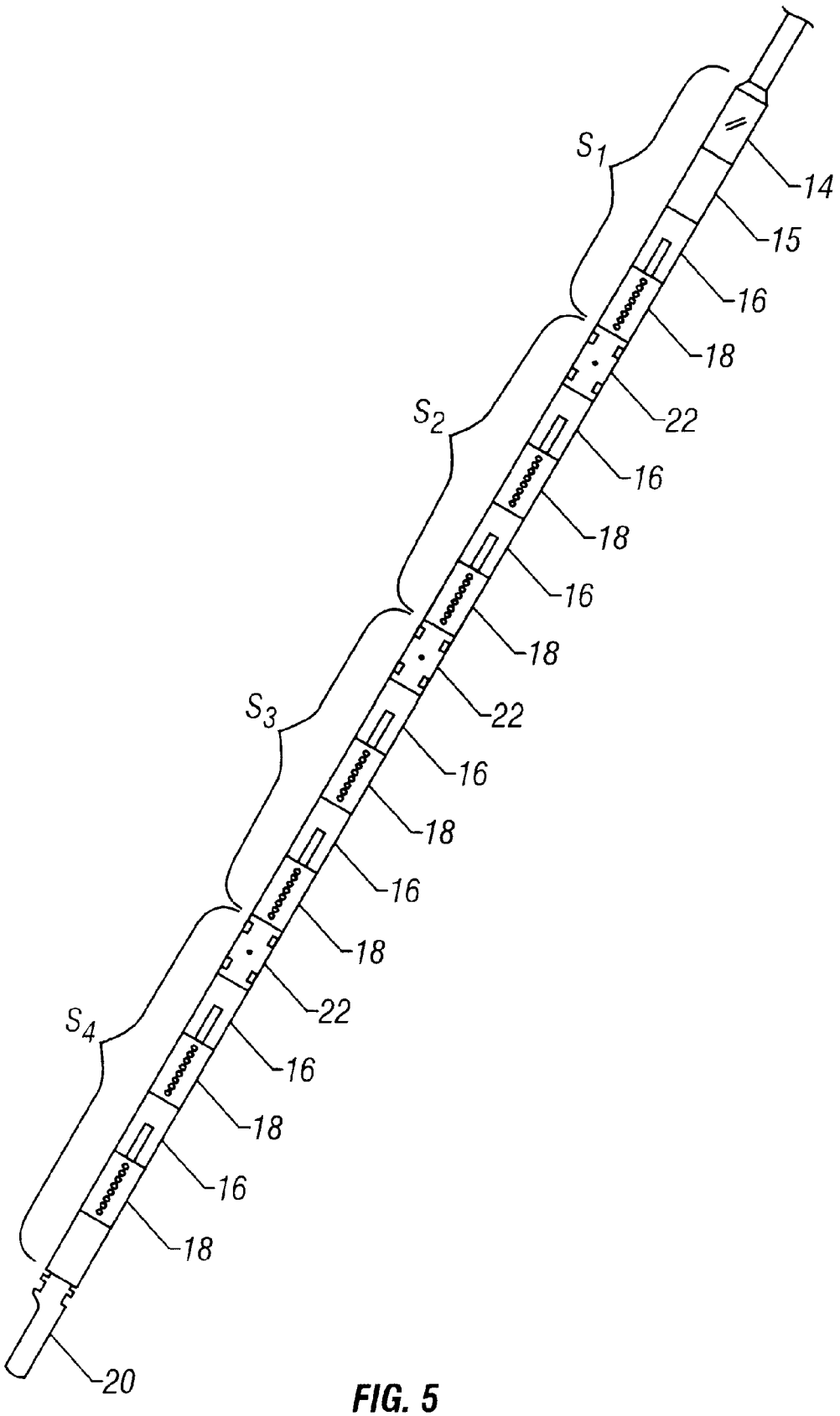
FIG. 5 illustrates a tool string with multiple sections separated by multiple shut-off valves.

Although the above description features a single shut-off valve in a tool string less than twice the length of the lubricator (such that it is removed in two sections), multiple shut-off valves 22 may be used within the same string of tools, thereby enabling the pressurized retrieval of extremely long tool strings. For example, FIG. 5 illustrates a single 200-foot tool string with three shut-off valves 22, designed to be retrieved in four 50-foot sections labeled $S_1$, $S_2$, $S_3$ and $S_4$. Tool strings such as this, which have internal hydraulic conduits running through perforating guns 18 to reach lower hydraulically activated tools (such as firing heads 16), are particularly useful applications of the above-described shut-off valve, as such conduits are very susceptible to damage during perforation.

In situations in which the entire lubricator may be pressurized, shut-off valve 22 may be used with a BOP with a single set of rams (and a single seal) by sealing the BOP against the valve housing below pressure activation port 54 and pressurizing the entire lubricator to activate the valve. In this case the valve housing may have only one reduced diameter sealing region to correspond with the single BOP seal. The steps involved in retrieving the tool string would be similar to those already described.

Other variations of the tool and method of the invention described above will also be apparent to those of skill in the art. For instance, a compression spring may be employed to help hold piston 52 in its closed position. For enhanced reliability, double shut-off valves 22 may be made up between each tool string section to ensure retrieval in the event a single valve fails to close. Other embodiments are also within the scope of the following claims.

What is claimed is:

1. A shut-off valve for use in a downhole string of tools adapted to be retrieved from a well under pressure, the valve comprising a housing having upper and lower ends configured for attachment to upper and lower portions, respectively, of the tool string, the valve defining an internal passage for hydraulic communication between the upper and lower tool string portions; and a piston slidably disposed within an axial bore of the housing and arranged to, in first and second positions, permit and block, respectively, hydraulic communication along the internal passage;

the housing having an outer surface defining upper and lower outer surface regions for engagement by two spaced apart seals of a retrieval head, the housing also defining an outer port disposed between the upper and lower outer surface regions and arranged for hydraulic communication between the piston and the outer housing surface;

the piston adapted to be moved to its second position by an elevated pressure applied to the outer port, thereby blocking the internal passage and enabling the upper end of the housing to be disconnected from the upper tool string portion while the lower tool string portion is exposed to elevated well pressure.

2. The shut-off valve of claim 1 wherein at least one of said upper and lower outer surface regions of the housing defines a reduced outer housing diameter and has an edge defining a locating shoulder adapted to be engaged by the retrieval head to axially locate the valve within the retrieval head.

3. The shut-off valve of claim 1 further comprising a frangible element extending between the piston and housing to temporarily retain the piston in its first position, and arranged to be broken by an application of elevated pressure at the outer port to enable the piston to be moved to its second position.

4. The shut-off valve of claim 3 wherein the housing comprises a bore sleeve defining the axial bore of the housing; and a floating sleeve, the frangible element extending between the piston and the floating sleeve, such that, with the frangible element in an unbroken condition, the floating sleeve is arranged to bear against the bore sleeve as hydraulic force is applied to the piston to urge the piston toward its second position, and to remain unloaded as hydraulic force is applied to the piston to urge it away from its second position.

5. The shut-off valve of claim 3 wherein the frangible element comprises multiple shear pins.

6. The shut-off valve of claim 1 further comprising a collapsible element arranged to be plastically deformed by the piston as the piston moves to its second position, thereby absorbing piston kinetic energy.

7. The shut-off valve of claim 6 wherein the collapsible element comprises a coil of tubing arranged to be crushed axially between the housing and the piston.

8. The shut-off valve of claim 1 wherein the upper and lower outer surface regions of the housing are adapted to be engaged by a dual combination blow-out preventer.

9. A shut-off valve for use in a downhole string of tools adapted to be retrieved from a well under pressure, the valve comprising a housing having upper and lower ends configured for attachment to upper and lower portions, respectively, of the tool string, the valve defining an internal passage for hydraulic communication between the upper and lower tool string portions; and a piston slidably disposed within an axial bore of the housing and arranged to, in first and second positions, permit and block, respectively, hydraulic communication along the internal passage;

the housing having an outer surface with a sealing region for engagement by a retrieval head seal, the housing also defining an outer port disposed above the sealing region and arranged for hydraulic communication between the piston and the outer housing surface;

the piston adapted to be moved to its second position by an elevated pressure applied to the outer port, thereby blocking the internal passage and enabling the upper end of the housing to be disconnected from the upper tool string portion while the lower tool string portion is exposed to elevated well pressure.

10. A method of uncoupling upper and lower portions of a string of tools exposed to elevated well bore pressure, the method comprising providing a shut-off valve made up between the upper and lower portions of the string, the shut-off valve comprising a housing having upper and lower ends configured for attachment to upper and lower portions, respectively, of the tool string, the valve defining an internal passage for hydraulic communication between the upper and lower tool string portions; and a piston slidably disposed within an axial bore of the housing and arranged to, in first and second positions, permit and block, respectively, hydraulic communication along the internal passage;

the housing having an outer surface with a sealing region for engagement by a retrieval head seal, the housing also defining an outer port disposed above the sealing region and arranged for hydraulic communication between the piston and the outer housing surface;

the piston adapted to be moved to its second position by an elevated pressure applied to the outer port, thereby blocking the internal passage and enabling the upper end of the housing to be disconnected from the upper tool string portion while the lower tool string portion is exposed to elevated well pressure;

raising the string from the well through a retainer head until the shut-off valve is disposed within the retainer head and the upper string portion is disposed within an enclosed chamber;

engaging the sealing region of the shut-off valve by a seal of the retainer head;

applying elevated pressure to the outer housing port to move the piston to its second position and close the shut-off valve;

reducing pressure within the enclosed chamber;

removing the upper string portion;

pressurizing the enclosed chamber;

retracting the retaining head seal; and raising the lower string portion into the enclosed volume.

11. A method of retrieving a string of tools through well head equipment, the string including an assembly having an inner fluid conduit, the method comprising:

raising the string until the assembly is at a predetermined position relative to the well head equipment;

applying a fluid pressure through the well head equipment to the assembly, the applied fluid pressure moving a member slidably arranged in the assembly from a first position to a second position to close off communication through the inner fluid conduit; and after closing off communication through the inner fluid conduit, detaching a portion of the string above the assembly.

12. The method of claim 11, wherein the member includes a piston having an inner bore and a port in communication with the inner bore, the assembly inner conduit including at least part of the inner bore of the piston, and wherein moving the piston to a second position includes moving the port to a sealed position.

13. An apparatus to enable retrieval of a string of tools from a well under pressure, comprising:

a shut-off valve coupled in the string between successive tools, the shut-off valve including:

a housing defining an inner passage for fluid communication between the successive tools, a member slidable within an axial bore of the housing to permit fluid communication through the inner passage in a first position and block fluid communication in a second position, and a port; and well head equipment including a source of fluid pressure coupled to the shut-off valve port, the fluid pressure being communicated to the shut-off valve port to actuate the slidable member from the first position to the second position.

14. The apparatus of claim 13, wherein the shut-off valve housing includes an upper chamber and a lower chamber, and wherein the member includes an inner bore in communication with both the upper and lower chambers when the member is in the first position, the inner passage including the upper and lower chambers and the bore of the member.

15. The apparatus of claim 14, wherein the bore of the member is sealed off from at least one of the upper and lower chambers when the member is in the second position.

16. The apparatus of claim 13, further comprising one or more shut-off valves coupled to one or more other tools.

17. The apparatus of claim 13, wherein the well head equipment further includes one or more sealing elements adapted to engage one or more outer surface portions of the shut-off valve.

18. The apparatus of claim 17, wherein the one or more sealing elements define an enclosed chamber through which fluid pressure from the source is communicated to the shut-off valve port.

* * * * *